United States Patent [19]

Ibrahim

[11] 4,370,867

[45] Feb. 1, 1983

[54] OPEN TOP REFRIGERATED DISPLAY CASE WITH AMBIENT AIR DEFROST

[75] Inventor: Fayez F. Ibrahim, Niles, Mich.

[73] Assignee: Tyler Refrigeration Corporation, Niles, Mich.

[21] Appl. No.: 244,959

[22] Filed: Mar. 18, 1981

Related U.S. Application Data

[63] Continuation-in-part of Ser. No. 145,859, May 1, 1980, Pat. No. 4,314,457, and a continuation-in-part of Ser. No. 76,669, Sep. 18, 1979, Pat. No. 4,314,453, and a continuation-in-part of Ser. No. 60,459, Jul. 25, 1979, abandoned, and a continuation-in-part of Ser. No. 11,804, Feb. 14, 1979, abandoned, and a continuation-in-part of Ser. No. 225,997, Jan. 19, 1981, Pat. No. 4,338,792.

[51] Int. Cl.[3] ..... A47F 3/04

[52] U.S. Cl. ..... 62/256; 62/282

[58] Field of Search ..... 62/256, 82, 282

[56] References Cited

U.S. PATENT DOCUMENTS

| | | | |
|---|---|---|---|
| 3,324,783 | 6/1967 | Hickox | 62/256 X |
| 4,120,174 | 10/1978 | Johnston | 62/256 |
| 4,295,340 | 10/1981 | Abraham | 62/256 X |
| 4,300,358 | 11/1981 | Hino et al. | 62/256 |

*Primary Examiner*—William E. Tapolcai, Jr.
*Attorney, Agent, or Firm*—Le Blanc, Nolan, Shur & Nies

[57] ABSTRACT

An open top refrigerated display case having an ambient air defrost system and a method of operating such display case, at least one air conduit extends in a U-shaped formation along opposing side walls and a bottom wall of the refrigerated display case. Each of the air conduits has an opening at both ends with such openings being located at upper portions of the side walls and in alignment so as to direct air across the access opening for recirculation through the air conduit during a refrigeration cycle of operation. Arranged within the primary air conduit is a set of refrigeration coils and at least one reversible fan for circulating air through such air conduit. During a refrigeration cycle of operation, the fan circulates air through the air conduit in a first direction through the refrigeration coils. During a defrost cycle of operation, the fan circulates air through the air conduit in the opposite direction and draws in ambient air from outside of the display case. During such defrost cycle of operation, the air leaving the air conduit is directed and supplied with a sufficient momentum so that such air travels along a path over the opposing side wall of the display case so that the air does not reenter the air conduit.

16 Claims, 6 Drawing Figures

OPEN TOP REFRIGERATED DISPLAY CASE WITH AMBIENT AIR DEFROST

RELATED APPLICATIONS

The present application is a continuation-in-part of the following applications: Ser. No. 225,997 entitled REFRIGERATED MERCHANDISER DISPLAY CASE WITH DEFROST DEVICE, filed Jan. 19, 1981 now U.S. Pat. No. 4,338,792; Ser. No. 145,859, entitled ISLAND REFRIGERATED DISPLAY CASE WITH AIR DEFROST, filed May 1, 1980, now U.S. Pat. No. 4,314,457; Ser. No. 76,669, entitled ONE AND A HALF BAND REFRIGERATED DISPLAY CASE, filed Sept. 18, 1979, now U.S. Pat. No. 4,314,453; Ser. No. 60,459, entitled OPEN TOP REFRIGERATED DISPLAY CASE HAVING AMBIENT AIR DEFROST, filed July 25, 1979, now abandoned; and Ser. No. 11,804 entitled OPEN TOP REFRIGERATED DISPLAY CASE, filed Feb. 14, 1979, now abandoned. Each of the above-identified applications is hereby incorporated by reference.

BACKGROUND OF THE INVENTION

The present invention relates to open top refrigerated display cases having an ambient air defrost system. Both within the specification and the claims of the present application, all references to refrigeration apparatus or refrigeration operations are intended to include cooling both at a temperature below 32° F., such as associated with frozen food display cases, and in excess of 32° F., such as typically associated with dairy food and fresh meat display cases.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possible to avoid any significant frost buildup within the display case.

Typically within the prior art, there have been three different approaches employed for defrosting refrigerated display cases. The first approach involves total reliance on the use of electric resistance heaters that are arranged adjacent to the refrigerated coils of the refrigeration mechanism. During a defrost cycle, these heaters supply heat in an effort to eliminate the frost buildup on the coils. The particular technique is relatively simple both in its construction and operation. However, since the electrical heaters are high voltage heaters that utilize significant electricity during operation, with the rapidly increasing cost of electricity it has become extremely uneconomical to employ such systems as the primary and sole source of heat for defrosting the coils.

A second type of system circulates hot compressed gaseous refrigerant through the refrigeration coils during the defrost cycle. During the defrost cycle, a valve control mechanism shuts off the supply of refrigerant to the refrigeration coils and alternatively feeds superheated compressed gaseous refrigerant through the coils. This hot gas serves to melt away any frost buildup that has accumulated on the refrigeration coils but simultaneously provides heat within the air conduit which can be circulated through the display case, which is disadvantageous. While this type of system does not suffer from the high cost of operation of the electrical heater defrost system, the use of heated gas involves a relatively high construction cost. Due to the requirement that the system be able to selectively switch between the supply of heated gas and refrigerant to the refrigeration coils, a complicated valving structure must be provided. Such a mechanism significantly increases the cost of construction of the display case. In addition, the provision of such a complicated system only increases the number of complex parts capable of breaking down and necessitating costly repairs.

A third type of system employed for defrosting display cases relies upon ambient air. It is this general category with which the invention of the present application is concerned. One type of system that employs ambient air during the defrost cycle is exemplified by those embodiments illustrated in U.S. Pat. Nos. 3,404,525, 3,850,003 and 3,937,033 all to Beckwith et al. Each of these systems uses fans separate from the main air circulating fans for circulating air during the defrost cycle of operation. These extra fans are turned on during the defrost cycle for pulling ambient air from outside of the display case into the air conduits. A second type of system is illustrated in U.S. Pat. No. 3,082,612 to Beckwith, which system draws ambient air into the main air circulation path through ports located in the lower front part of the refrigerated display case. Such ports are normally closed during the refrigeration cycle and are open during the defrost cycle. The Beckwith et al. '003 patent indicates that the concepts described in U.S. Pat. Nos. 3,082,612 and 3,403,525 did not prove to be practical and hence were not commercially feasible.

Finally a third type of air defrosting system is shown in U.S. Pat. No. 4,144,720 to Subera et al. which is assigned to the same assignee as the present application. In the foregoing patent, an open front refrigerated display case having primary and secondary air conduits is disclosed. In this system, reversible fans are employed for reversing the direction of flow of air within the conduits and simultaneously drawing in air from outside of the display case.

Another system employing reversible fans for ambient air defrost is shown in U.S. Pat. No. 4,026,121 to Aokage et al. This patent, however, refers to short-circuiting the air flow between the primary and secondary air bands for the purpose of supplying warmer air to the primary band.

It has been recognized that an ambient air defrost operation can be incorporated into an open top refrigerated display case as disclosed in German Offenlegungsschrift No. 21 23 646 and U.S. Pat. Nos. 4,120,174 to Johnston and 4,182,130 to Ljung. This German patent illustrates an open top refrigerated display space having an ambient air defrost system. While during the defrost cycle of operation the direction of the air flow is reversed, the quantity and velocity of such flow remain unchanged. The patent to Ljung illustrates an island display case in which a tube arranged within the central wall extends above the display case for drawing in ambient air during the defrost cycle of operation. The direction of the air flow during the defrost cycle of operation is the same as the direction during the refrigeration cycle of operation and the air continues to be omitted out of the same outlet openings.

The Johnston patent illustrates an open top display case having a single air conduit extending around the case. During the refrigeration cycle, the air flows in a first direction and during the defrost cycle the direction of air flow is reversed with ambient air being drawn into the conduit. The quantity of air flow during the defrost cycle is greater than the refrigeration air flow. The defrost air, after passing through the conduit, is expelled in a direction up and over the access opening in the top of the refrigerated display case. It has been found during the development of the present invention that with a defrost air flow pattern such as disclosed in the Johnston patent that a significant portion of the expelled air will fall back towards the access opening in the refrigerated case and reenter the air conduit at the other side of the access opening. The existance of such an air flow pattern has been confirmed by brochures released by Kysor Industrial Corporation, the assignee of the Johnston patent wherein in the island display cases the air flow patterns illustrated show that the defrost air reenters the air conduit and hence is recirculated through such conduits. The air flow patterns illustrated in the Kysor brochures are shown in FIGS. 1 and 2 of the present application, which figures are labeled as prior art.

When ambient air surrounding the refrigerated display case is drawn in and utilized as a source of thermal energy in order to defrost the refrigeration coils, the ambient air after passing through the frosted coils can be at a low temperature, particularly during the initial portion of a defrost cycle. In such a condition, the ambient air does not cause thermal shock to the stored products if it should come in contact therewith during a defrost cycle of operation. However, during the terminal portion of the defrost cycle the defrost ambient air is elevated to a temperature above the temperature of the air mass in the display section of the case that surrounds the stored products and hence this defrost air will cause thermal shock to the products when coming into contact with the products. This problem is particularly acute in the defrosting of open top cases with ambient air.

One approach to alleviating the problem caused by the defrost ambient air coming into contact with the stored refrigerated products is to construct the case or cabinet with guide means which during the defrost cycle of operation directs the defrost air upwardly so as to lie over the access opening of the case. German Offenlegungsschrift No. 28 04 008, published Aug. 3, 1978 shows a guide plate 29 in FIG. 1 which directs defrost air upward from the normal flow conduit in order to expell the defrost air to the space above the stored products. This defrost air being cooler than the ambient air tends to settle back toward the display space. The defrost air then will come into contact with the products in the display space and also will be drawn back into the air conduit and recirculated. This case suffers from the same problems of the case disclosed in the patent to Johnston.

Another air guide device is set forth in Australian Patent Specification No. 51774/79 where an inverted U-shaped channel is used to guide ambient defrost air away from the stored refrigerated products and downwardly toward the outside of the display cabinet. The operation of this system leaves the display space unprotected from the ambient air above the case. The contact of the ambient air with the air in the display space may result in thermal shock to the products within the case.

Another solution to the above stated problem is set forth in U.K. Patent Application Ser. No. 20166 69A which illustrates an open front display case. Here the changing thermal and volumetric differences between the defrost ambient air band and the air mass surrounding the stored products are utilized together with a means to create a negative pressure in the display space. The defrost air is first permitted into the display space and is thereafter caused to be directed away from the display space without the provision of special guide means.

U.S. Pat. No. 3,324,783, to Hickox, assigned to the same assignee as the present invention, discloses a restricting slot 18 in an air conduit for a different purpose. In that patent, the restriction slot causes a back pressure which results in a uniform distribution of the propelled air along the longitudinal dimension of the merchandise cabinet so that the air flow is uniform prior to passing through an air directing grid structure. The purpose of the grid structure is to allow the refrigerated air band to flow more uniformly across the open top of the cabinet. There is no provision in this patent for expelling an air band away from the cabinet.

SUMMARY OF THE INVENTION

An object of the present invention is to provide an improved open top refrigerated display case having an ambient air defrost system.

Another object of the present invention is to provide an improved open top refrigerated display case having an ambient air defrost system in which during the defrost cycle of operation a protective barrier air curtain is maintained across the access opening while simultaneously preventing defrost air from being recirculated through the air conduit of the display case.

A further object of the present invention is to provide an improved open top refrigerated display case utilizing an ambient air defrost system in which thermal shock to the products within the display case is substantially prevented during the defrost cycle of operation.

Still another object of the present invention is to provide an open top refrigerated display case having an ambient air defrost system where during a defrost cycle of operation ambient air is drawn into the air conduit and circulated through the conduit in a reverse flow direction and then expelled from the conduit with sufficient momentum and along a path so that such air is propelled over the opposing side wall of the display case.

Still a further object of the present invention is to provide an ambient air defrost system within an open top refrigerated display case where the defrost ambient air during the defrost cycle is expelled from the air conduit with sufficient momentum and along a path so that such defrost air flows over the opposing side wall of the display case in order to provide a barrier air curtain across the access opening and simultaneously prevent the defrost air from reentering the air conduit.

A still further object of the present invention is to provide an ambient air defrost system within an open top refrigerated display case in which the velocity of the ambient air leaving the air conduit during the defrost cycle of operation is increased to a sufficient extent so that such air is propelled along a path with sufficient momentum for flowing over the opposing side wall of the display case.

All of the above-noted objectives are accomplished in the operation of the open top refrigerated display case of the present invention. The refrigerated display case of the present invention has either a single or two air conduits that extend in a substantially U-shaped formation along the bottom and side walls of the case so as to encircle the display space. An opening in the top of the refrigerated display case enables the consumer to have access to the products within the display space. During a refrigeration cycle of operation, air is circulated through the air conduits. The air circulated through the primary air conduit is refrigerated during the refrigeration cycle of operation and such air is emitted from an outlet opening of the primary air conduit along a path so as to be directed across the access opening of the case and received back into the air conduit through the inlet opening of such conduit. The refrigerated air is then recirculated so as to form a continuous air band. During the defrost cycle of operation, the operation of the evaporator coils is temporarily terminated and ambient air from outside of the display case is drawn into the air conduit. During the defrost cycle of operation, the air circulating mechanism draws ambient air into the primary air conduit and causes such ambient air to flow through the primary air conduit in a direction opposite the direction of air flow during the refrigeration cycle of operation. This defrost ambient air is then expelled from the primary air conduit through the inlet opening of such conduit. The expelled defrost ambient air is caused to flow in a direction and with sufficient momentum so that such air travels along a path carrying the air over the opposite side wall of the display case thereby forming a protective barrier across the access opening of the display case while simultaneously preventing such air from reentering the air conduit.

In order to provide sufficient momentum to the air expelled from the air conduit during the defrost cycle of operation to insure that such air is propelled over the opposing side wall of the display case, the velocity of the air is increased prior to being expelled from the air conduit. The velocity of such air can be increased by squeezing the cross-sectional area of the air flow prior to expelling the air from the air conduit. The air volume passing through an unrestricted portion of an air conduit is defined by the following equation:

$$Q = A \times V$$

where, Q is the volumetric flow in cubic feet per minute; A is the cross-sectional area in square feet; and V is air velocity in feet per minute. It is assumed, for purposes of exemplary calculations, that the air velocity $V_1$ through the primary portion of the air conduit is 200 feet per minute. The volumetric flow rate, Q, will remain the same throughout the conduit even if the cross-sectional area is restricted. Accordingly, if the cross-sectional area of the conduit is restricted, such as by placing a restriction baffle within the conduit, the air flow is squeezed thereby resulting in an increased velocity, $V_2$, for the air flow. Thus, where the cross-sectional area in the main portion of the air conduit as an example is 1.5 $ft^2$ then Q is calculated as follows:

$$\begin{aligned} Q &= A \times V_1 \\ &= 1.5\ ft^2 \times 200\ fpm \\ &= 300\ ft^3 \text{ per minute through the air conduit} \end{aligned}$$

If the cross-sectional area of the air conduit is now reduced to 0.9 $ft^2$ then $$V_2 = Q/A = 300/0.9 = 333.34\ fpm \text{ through the flow area}$$

Thus, restricting the flow area from 100% in the conduit to 60% of the area in the restricted area results in a 40% reduction in area and a 66% increase in the air flow velocity. This increase in the air flow velocity causes a resulting increase in the momentum of the air stream in accordance with the following equation:

$$\Delta M = m \times (V_2 - V_1)$$

where, $\Delta M$ is the change in momentum in pounds × minutes; m is the mass of air and pounds × minutes squared divided by feet and is obtained by dividing the weight of a given air volume by the gravitational constant expressed in consistant units; and $V_2$ and $V_1$ are the velocities in feet per minute. The increased momentum in the air band is then sufficient to cause the air expelled from the air conduit to be substantially fully propelled across the access opening and over the opposing side wall of the display case providing that the path along which the air is directed is appropriately selected. The direction of the air flow path is dependent upon the angle of the opening of the air conduit through which the defrost ambient air is expelled during the defrost cycle of operation.

In selecting the angle of the opening of the air conduit through which the defrost ambient air is to be expelled, such selection is dependent both upon the velocity of the air and the width of the display case. If the angle of such opening with respect to the horizontal is too great, for example, between 70° and 90°, then such air will be expelled along a path so that it is directed substantially upwardly and lies over the access opening. The air directed along such an upward path subsequently will loose its momentum and slowly sink back towards the access opening of the display case thereby possibly contacting the products within the display case and being drawn back into the other opening of the air conduit so that it is recirculated through such conduit. Alternatively, if the angle of the opening of the air conduit is too small, for example, between 0° and 20°, then the flow path of the expelled defrost ambient air will travel along a path so close to the display section that it may cause thermal shock to the products and so close to the opposite opening of the air conduit through which air is being drawn into the conduit thereby causing such defrost ambient air expelled from the air conduit to be drawn back into the air conduit and recirculated.

The restriction of the air conduit can be accomplished by the placement of a restriction baffle within the conduit. Such baffle in effect acts to squeeze the air flow to the smaller cross-sectional area. This baffle should extend along the entire length of the air conduit and should be in close proximity with the outlet opening so as to achieve the maximum effect on the expelled air flow.

In an alternative embodiment of the present invention, the higher momentum needed to insure that the defrost ambient air flow is propelled over the opposing side wall may be achieved by significantly increasing the volume of air flow during the defrost cycle of operation. The angle of the outlet opening, however, must still be appropriately selected so that the path along which the air travels will enable such air to be propelled over the opposing side wall with the level of momentum that the air has as it is expelled from the air conduit. In accordance with the preferred embodiment of the present invention, however, the velocity of the defrost ambient air flow is increased as it is being expelled from the air conduit.

DESCRIPTION OF THE PREFERRED EMBODIMENTS

Figure 1:
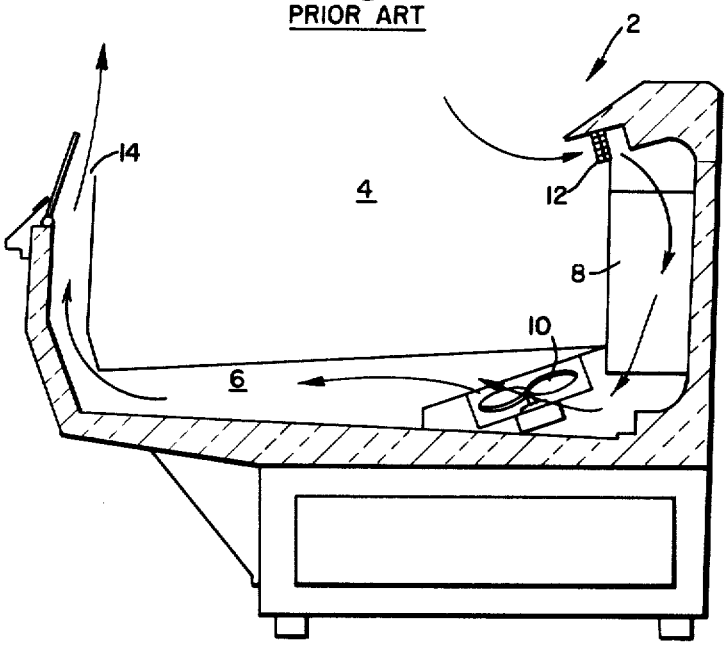
Fig. 1 PRIOR ART
FIG. 1 is a sectional side elevational view of a prior art refrigerated display case shown during an ambient air defrost cycle.
Figure 2:
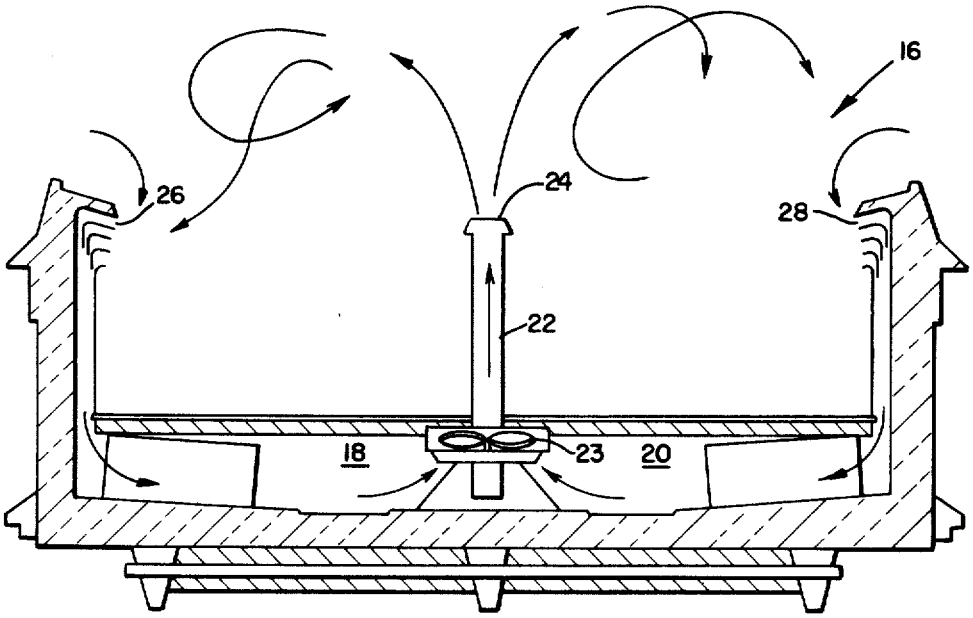
Fig. 2 PRIOR ART
FIG. 2 is a sectional side elevational view of a prior art island refrigerated display case shown during an ambient air defrost cycle.

FIGS. 1 and 2 illustrate prior art embodiments of open top display cases where such cases are being operated in an ambient air defrost cycle of operation. Display case 2 illustrated in FIG. 1 has a display space 4 that is surrounded by single air conduit 6. Arranged within air conduit 6 is a set of evaporator coils 8. Air is circulated through the air conduit by a set of fans 10 so that the air passes through the evaporator coils and is expelled out of outlet opening 12 and received back into the conduit through inlet opening 14. During a defrost cycle of operation, the direction of the air flow is reversed and flows along the path shown by the arrows in FIG. 1. Thus during the defrost cycle of operation, the ambient air is drawn into the outlet opening 12 and expelled from the conduit through inlet opening 14. Such air is expelled in an upwardly direction and essentially lies over the access opening to display space 4. As described in connection with FIG. 2 below, air traveling along such path has a tendency to resettle back towards the display space thereby creating the possibility of thermal shock to products within the display space and enabling such air to be drawn back into the air conduit and recirculated through the conduit, which slows down the defrost operation.

An island refrigerated display case 16 in accordance with the prior art is shown in FIG. 2. This display case has two display spaces with two air conduits 18 and 20, each encircling one of the display spaces. The two air conduits have a single joint central portion 22 and a fan 23 circulates air through both of the conduits. During the defrost cycle of operation, the direction of air flow through the conduits is reversed and flows along the lines shown by the arrows in FIG. 2. Thus, during the defrost cycle of operation, the defrost air is expelled out of opening 24 of conduit portion 22 in a substantially upward direction. This defrost air, however, being cooler than the ambient air although warmer than the temperature in the display space tends to settle back towards the display space thereby creating the possibility of thermal shock to the products within the display spaces and also reentering the air conduits for recirculation through the conduits. Since the expelled defrost air is cooler than ambient air, the reentry of such air into the air conduit acts to slow down the defrost cycle of operation.

Figure 3:
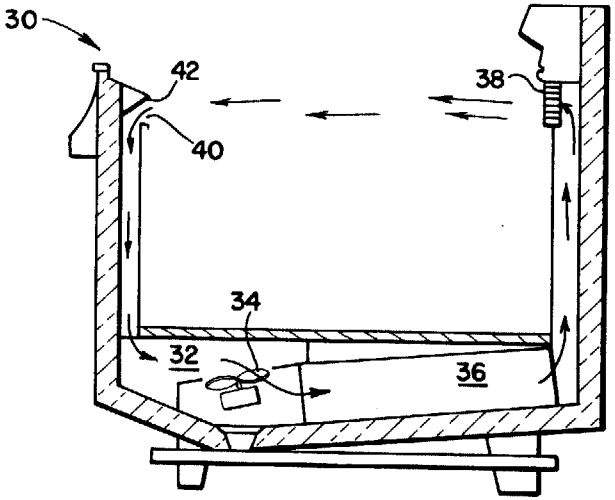
FIG. 3 is a sectional side elevational view of a refrigerated display case of the present invention shown during a refrigeration cycle of operation.

A first embodiment of an open top refrigerated display case 30 in accordance with the present invention is illustrated in FIG. 3. Display case 30 has a single air conduit 32 that encircles the display space. Conduit 32 has an outlet opening 38 and an inlet opening 40. Openings 38 and 40 are in alignment so that air emitted from opening 38 during a refrigeration cycle of operation is directed across the access opening and received back into the conduit through opening 40. A set of fans such as fan 34 circulates air through air conduit 32. During the refrigeration cycle of operation a set of evaporator coils 36 circulates air through the air conduit along the path shown by the arrows in FIG. 3.

Figure 4:
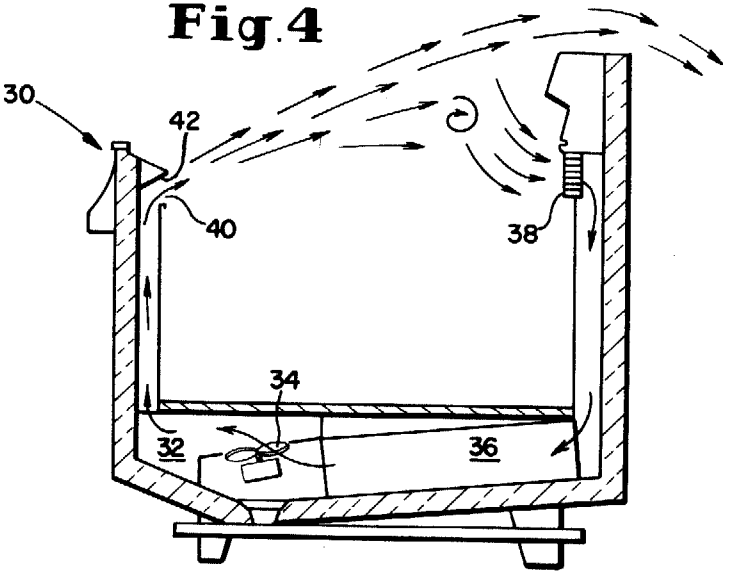
FIG. 4 is another view of the display case shown in FIG. 3 except that it is being operated in the defrost cycle of operation.

When the display case is to be defrosted, the operation of the evaporator coils 36 is temporarily terminated and the direction of air flow through air conduit 32 is reversed by reversing the direction of operation of fan 34. The arrows in FIG. 4 show the air flow direction through display case 30 during a defrost cycle of operation. As can be seen, ambient air from outside of the case is drawn into air conduit 32 through opening 38 during the defrost cycle. This defrost ambient air is then circulated through the air conduit and expelled through opening 40. The contour of upper wall portion 42 that forms part of opening 40 helps to direct the air expelled from the conduit along a path so that it tends to flow up and over the opposing side wall of the display case. If the air emitted from the air conduit 32 through opening 40 is supplied with sufficient momentum then the air will be propelled over the opposing side wall.

In accordance with the embodiment shown in FIG. 4, during the reverse air flow of the defrost cycle of operation, a greater quantity of air is propelled along the air conduit than during a refrigeration flow of operation in order to increase the momentum of the air. As shown in the operation of this embodiment, depending on the momentum provided to the air flow there may be some minor tendency for some portion of the air to be drawn back into the air conduit as shown by the arrows in the figure. The air, however, is substantially prevented from reentering the air conduit and likewise from coming into contact with the products in the display space.

The flow of air across the access opening and above the opposing side wall also acts as a barrier curtain for protecting the refrigerated air within the display space of refrigerated display case 30 from the warmer ambient air above the display case. This protection is particularly significant where air for heating the building is being expelled into the area around the display case from ducts located in the ceiling of the store. The air for heating the building is typically directed in a downward manner towards the floor from the ceiling and such air is prevented from reaching the products within the display space by the protective air curtain that is maintained across the access opening during both the refrigeration cycle of operation and the defrost cycle of operation in accordance with the present invention.

Figure 5:
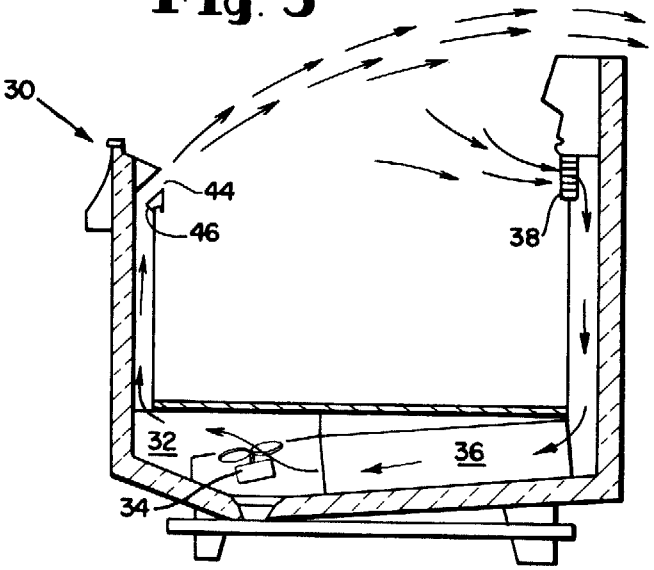
FIG. 5 is a sectional side elevational view of a modified embodiment of a refrigerated display case in accordance with the present invention shown during a defrost cycle of operation.

In a second embodiment of the present invention, instead of increasing the quantity of air moving through air conduit 32, the velocity of the air expelled from the air conduit is increased during the defrost cycle of operation. Such an embodiment is shown in FIG. 5. In the area of opening 44 of air conduit 32, a restricting baffle 46 is arranged so as to decrease the cross-sectional area of such opening as compared to the cross-sectional area of the air conduit below the opening. Baffle 46 has the effect of squeezing the air into a smaller cross-sectional area which simultaneously increases the velocity of such air as previously discussed above. The increase in the velocity of the air provides the expelled defrost ambient air with sufficient momentum for being propelled over the opposing side wall of the display case as shown by the arrows in FIG. 5.

Figure 6:
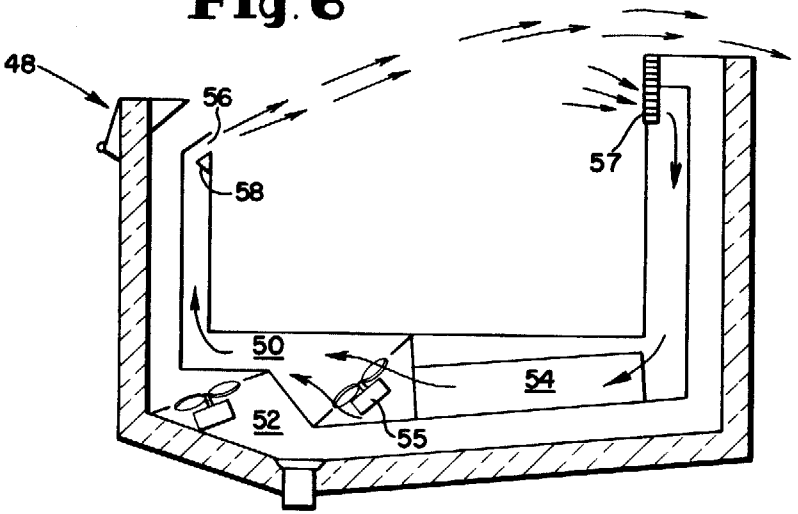
FIG. 6 is a sectional side elevational view of another embodiment of a refrigerated display case in accordance with the present invention shown during a defrost cycle of operation.

In another embodiment of the open top refrigerated display case of the present invention, a secondary air conduit can be provided such as shown in FIG. 6. Refrigerated display case 48 is provided with a primary air conduit 50 and a secondary air conduit 52. Arranged within the primary air conduit 50 are the evaporator coils 54 and fans 55. Display case 48 in FIG. 6 is shown during the defrost cycle of operation. During such defrost cycle, the air flow through secondary air conduit 52 is terminated. In addition, the air flow through primary air conduit 50 is reversed in direction and the operation of the evaporator coils 54 is temporarily terminated. Ambient air is then drawn into opening 57 of air conduit 50 and the defrost ambient air is expelled from the conduit through opening 56. The reverse air flow through primary air conduit 50 during the defrost cycle of operation either can be increased in quantity or can have its velocity increased. In order to increase the velocity of such air flow a restricting baffle 58 is provided within the proximity of opening 56 of the conduit. Baffle 58 squeezes the air by reducing the cross-sectional area thereby increasing the velocity of such air. As previously discussed, the increase in the velocity of the air provides the expelled air with sufficient momentum so that the air is propelled over the opposing side wall of the display case.

In accordance with one preferred embodiment of a refrigerated display case of the type shown in FIG. 5 in accordance with the present invention, the angle of construction of the opening 44 is approximately 45° in order to expel the defrost air along a path so that it flows over the opposing side wall. In this particular embodiment, the width of the access opening of the display case is 32 inches and the width between the outer edges of the walls is 40 inches. The restriction member 46 is constructed for this embodiment so that it increases the air speed by 50%.

The angle of opening 44 should be between 25° and 65°. Where the access opening has a width of approximately 32 to 40 inches, the minimum increase in the air speed normally should be at least 25%.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. An open top refrigerated display case capable of selective operation in a refrigeration cycle and a defrost cycle of operation, said display case comprising: a bottom wall and four side walls; a single air conduit extending around a first of said side walls, along said bottom wall and a second of said side walls, said first and second side walls being opposing side walls, said air conduit having first and second openings at its opposite ends and each of said openings being located near the top portion of the respective said side wall; means for refrigerating air moving through said air conduit during a refrigeration cycle, said means for refrigerating being arranged within said air conduit; air circulating means arranged within said air conduit, said air circulating means circulating air within said air conduit in a forward direction during a refrigeration cycle and circulating air in a reverse direction during a defrost cycle, and said air circulating means drawing in ambient air from outside of said display case through said first opening when said air circulating means circulates air within said air conduit in the reverse direction; means for switching the operation of said display case between a refrigeration cycle and a defrost cycle and correspondingly causing said air circulating means to change the direction of circulation of air within said air conduit; and means for directing air leaving said air conduit during a defrost cycle of operation in a direction along a path for carrying such air over the opposite wall of said display case and said means for directing the air including means for increasing the velocity of the air leaving said air conduit during a defrost cycle of operation so as to impart a sufficient velocity and momentum to such air for causing the air to transverse the access opening within said display case and to flow over the opposing side wall so that such air forms a protective air curtain across said access opening while being simultaneously substantially prevented from reentering said air conduit.

2. A refrigerated display case according to claim 1 wherein said first opening within said air conduit serves as an air outlet during a refrigeration cycle and said second opening serves as a return air inlet during a refrigeration cycle, said first and second openings are aligned so that at least a substantial portion of air leaving said first opening during a refrigeration cycle is received within said second opening thereby enabling a continuous refrigerated air band to be established within said display case during a refrigeration cycle.

3. A refrigerated display case according to claim 1 or 2 wherein during a defrost cycle of operation, said air circulating means serves to draw in ambient air surrounding said display case into said air conduit through said first opening; and said second opening and the portion of said air conduit adjacent to said opening are constructed such that air leaving said second opening during a defrost cycle of operation is directed along a path for causing such air to flow over the opposing side wall of said display case.

4. A refrigerated display case according to claim 3 wherein said means for increasing the velocity of air leaving said second opening during a defrost cycle of operation includes means for partially restricting the width of said air conduit at a location within the proximity of said second opening of said air conduit.

5. A refrigerated display case according to claim 3 wherein said means for increasing the velocity of air leaving said second opening during a defrost cycle of operation includes means for enabling such velocity to be increased while maintaining the quantity of air leaving said second opening.

6. A refrigerated display case according to claim 3 wherein said second opening and the portion of said air conduit adjacent to said second opening are oriented at an appropriate angle selected in dependence upon the width of the display case and the velocity of the air leaving said second opening during a defrost cycle of operation for enabling such air to be directed along a path for traveling over the opposite side wall of said display case.

7. A refrigerated display case according to claim 1 wherein during a defrost cycle of operation, said air circulating means increases the volume of the air flowing through said air conduit in a reverse direction so that the momentum of air leaving said air conduit is increased to a sufficient level for enabling such air to be propelled over the opposing said side wall.

8. A refrigerated display case according to claim 1 or 7 further comprising means for increasing the velocity of air leaving said air conduit during a defrost cycle of operation so that such air has a sufficient momentum for enabling such air to be propelled over the opposing said side wall of said display case in order to prevent such air from reentering said air conduit.

9. An open top refrigerated display case being selectively operated in a refrigeration cycle and adefrost cycle, said display case comprising: a bottom wall and four side walls; an air conduit extending along a first of said side walls, along said bottom wall and a second of said side walls, said first and second side walls being opposing side walls, said air conduit having first and second openings at its opposite ends and each of said openings being located near the top portion of the respective said side wall; means for refrigerating air moving through said air conduit during the refrigeration cycle, said means for refrigerating being arranged within said air conduit; air circulating means circulating air within said air conduit in a forward direction during a refrigeration cycle of operation and circulating air in a reverse direction during a defrost cycle of operation, said air circulating means drawing in ambient air from outside of said display case through said first opening when said air circulating means circulates air within said air conduit in a reverse direction; means for switching the operation of said display case between a refrigeration cycle and a defrost cycle; means for directing air leaving said air conduit during a defrost cycle of operation along a path for causing such air to flow over the opposing said side wall of said display case; and, means for increasing the velocity of emitted defrost air to a sufficient velocity so that such air will flow over such opposing said side wall so that such air substantially avoids reentering said air conduit, and means for increasing the velocity of the air leaving said air conduit during a defrost cycle of operation including means for restricting a portion of the width of said air conduit in an area in the proximity of the second opening of said air conduit.

10. A display case according to claim 9 wherein said first opening within said air conduit serves as an air outlet during a refrigeration cycle and said second opening serves as a return air inlet during a refrigeration cycle of operation, said first and second openings are aligned so that at least a substantial portion of air leaving said first opening during a refrigeration cycle is received within said second opening thereby enabling a continuous refrigerated air band to be established within said display case during a refrigeration cycle of operation.

11. A refrigerated display case according to claim 10 wherein during a defrost cycle of operation, said air circulating means draws ambient air surrounding said display case into said air conduit through said first opening; and said second opening and the portion of said air conduit in the proximity of said second opening are constructed so that air leaving said second opening during a defrost cycle of operation is directed along a path for being propelled over the opposing said side wall of said display case.

12. A refrigerated display case according to claim 11 wherein said air circulating means circulates a greater quantity of air within said air conduit in a forward direction during a refrigeration cycle of operation than the quantity of air circulated through said air conduit during a defrost cycle of operation.

13. A refrigerated display case according to claims 1 or 9 further comprising a secondary air conduit extending at least partially around said display case and lying outside of said air conduit.

14. A refrigerated display case according to claim 13 wherein said secondary air conduit extends completely around said air conduit and has inlet and outlet openings lying immediately adjacent to the openings of said air conduit and in alignment so that air leaving said outlet opening will be directed across said access opening of said display case and received in said inlet opening for circulation through said secondary air conduit during a refrigeration cycle of operation.

15. A refrigerated display case according to claim 14 further comprising secondary air circulating means for circulating air through said secondary air conduit during a refrigeration cycle of operation and temporarily terminating the flow of air through said secondary air conduit during a defrost cycle of operation.

16. A refrigerated display case according to claim 1 or 9 wherein the velocity of the air emitted from said air conduit during a defrost cycle of operation is increased by at least 25% by said means for increasing the velocity of such air.

* * * * *